US012484712B2

(12) United States Patent
He et al.

(10) Patent No.: US 12,484,712 B2
(45) Date of Patent: Dec. 2, 2025

(54) CHILD CARE APPARATUS

(71) Applicant: GUANGZHOU MASTELA COMMODITY CO., LTD., Guangzhou (CN)

(72) Inventors: Yaming He, Maoming (CN); Guanlin Chen, Lianjiang (CN); Yingxin Hu, Guangzhou (CN)

( * ) Notice: Subject to any disclaimer, the term of this patent is extended or adjusted under 35 U.S.C. 154(b) by 234 days.

(21) Appl. No.: 18/460,700

(22) Filed: Sep. 5, 2023

(65) Prior Publication Data

US 2024/0415294 A1 Dec. 19, 2024

(30) Foreign Application Priority Data

Jun. 13, 2023 (CN) ..... 202310701141.5

(51) Int. Cl.
*A47D 9/02* (2006.01)

(52) U.S. Cl.
CPC ..... *A47D 9/057* (2022.08)

(58) Field of Classification Search
CPC ..... A47D 9/057; A47D 13/10; A47D 13/105; A47D 9/02; A47C 21/006; A47C 3/0257; A47C 19/045; A47C 7/462; A61G 7/012; A61G 7/1019; A61G 7/018
USPC ..... 5/105, 106, 108, 109
See application file for complete search history.

(56) References Cited

U.S. PATENT DOCUMENTS

2008/0179928 A1* 7/2008 Chen ..... A47D 13/10 297/260.1
2015/0245719 A1* 9/2015 Zhong ..... A47D 9/057 297/260.1
2021/0100368 A1* 4/2021 Juchniewicz ..... A47D 9/016

FOREIGN PATENT DOCUMENTS

CN 106175269 A * 12/2016 ..... A47D 9/02
CN 110151426 A * 8/2019 ..... A61G 7/05
WO WO-2017031782 A1 * 3/2017 ..... A47C 21/044

* cited by examiner

*Primary Examiner* — David R Hare
*Assistant Examiner* — George Samuel Gines
(74) *Attorney, Agent, or Firm* — Sam Pierce

(57) ABSTRACT

A child care apparatus includes a horizontal reciprocating motion mechanism, a vertical reciprocating motion mechanism, and a supporting device. The horizontal reciprocating motion mechanism includes a mounting cover. The vertical reciprocating motion mechanism is disposed at the mounting cover. The vertical reciprocating motion mechanism includes a lifting component and a driving mechanism for driving the lifting component to move, the lifting component is located in the mounting cover and passes through the mounting cover to extend out of the mounting cover, and the mounting cover is configured to limit rotation of the lifting component. The supporting device is located outside the mounting cover and is disposed on the lifting component. The child care apparatus has advantages of low noise, good balance, and good stability.

34 Claims, 7 Drawing Sheets

CHILD CARE APPARATUS

TECHNICAL FIELD

The present disclosure relates to a technical field of child products, and in particular to a child care apparatus.

BACKGROUND

Child care apparatuses are configured to care infants and toddlers to set both hands of caregivers of the infants and the toddlers free, thereby relieving pressure of the caregivers of the infants and the toddlers. Commonly, the child care apparatuses each includes a child seat, a crib, a cradle, etc., and each of the child care apparatuses may drive a child to move back and forth and/or left and right with respect to the ground, as so to please and pacify the child.

A Chinese patent No. CN104055355B discloses a variable-motion child seat, a second motor of the variable-motion child seat rotates in a first direction to drive the variable-motion child seat to reciprocate up and down, and a first motor of the variable-motion child seat rotates in a second direction to drive the variable-motion child seat to horizontally reciprocate. The variable-motion child seat may move independently in two dimensions or move simultaneously in the two dimensions through vertically reciprocating or horizontally reciprocating, a large number of motion trajectories are reproduced in the two dimensions so as to better imitate movements of the caregivers of the infants and the toddlers and further reduce the pressure of the caregivers of the infants and the toddlers.

However, the variable-motion child seat in the prior art has following disadvantages that a double-scissor mechanism is respectively connected to a supporting platform and a rigid platform, when the variable-motion child seat reciprocates up and down, the double-scissor mechanism not only has rolling friction with the rigid platform, but also has sliding friction respectively with the rigid platform and the supporting platform, such friction may easily generate noise, which is not beneficial to caring the infants and the toddlers.

SUMMARY

Based on above, the present disclosure aims to provide a child care apparatus having advantages of low noise, good stability, and good balance.

Aims of the present disclosure are achieved by following technical solutions.

The present disclosure provides a child care apparatus, including a horizontal reciprocating motion mechanism, a vertical reciprocating motion mechanism, and a supporting device. The horizontal reciprocating motion mechanism includes a mounting cover. The vertical reciprocating motion mechanism is disposed at the mounting cover. The vertical reciprocating motion mechanism includes a lifting component and a driving mechanism for driving the lifting component to move, the lifting component is located in the mounting cover and passes through the mounting cover to extend out of the mounting cover, and the mounting cover is configured to limit rotation of the lifting component. The supporting device is located outside the mounting cover and is disposed on the lifting component.

Furthermore, the lifting component includes a lifting cylinder. The driving mechanism includes a driving sleeve, and the driving sleeve is sleeved with the lifting cylinder.

Furthermore, the driving sleeve includes driving grooves, the lifting cylinder includes sliding components, and the sliding components are movably clamped in the driving grooves.

Furthermore, each of the driving grooves is a threaded groove or an annular groove having a slope.

Furthermore, at least two driving grooves are provided, and at least two sliding components are provided with respect to the at least two driving grooves; the at least two sliding components are respectively clamped in the at least two driving grooves.

Furthermore, a lowest point of a first driving groove in the at least two driving grooves is located above a highest point of a second driving groove in the at least two driving grooves, where the first driving groove is adjacent to the second driving groove; or, a highest point of the second driving groove in the at least two driving grooves is located above a lowest point of the first driving groove in the at least two driving grooves, where the second driving groove is adjacent to the first driving groove.

Furthermore, a fixing shaft and a fixing base are disposed in the mounting cover, the fixing base is fixedly connected to a bottom of the mounting cover, the fixing base is located below the fixing shaft, and two ends of the fixing shaft are respectively and fixedly connected to the fixing base and the mounting cover.

Furthermore, the lifting cylinder is sleeved on the fixing shaft, and at least one first rolling component is disposed between the lifting cylinder and the fixing shaft.

Furthermore, a connecting component is disposed at a top of an inner cavity of the mounting cover, a connecting groove is defined on the connecting component, and the fixing shaft is fixed in the connecting groove.

Furthermore, the driving sleeve is located in the mounting cover; a first gap exists between an outer wall of the driving sleeve and the inner cavity of the mounting cover, and a second gap exists between a top of the driving sleeve and the inner cavity of the mounting cover; a second rolling component is disposed between the driving sleeve and the connecting component.

Furthermore, an axis of the at least one first rolling component and an axis of the second rolling component are located in a straight line.

Furthermore, a connecting sleeve is disposed on the fixing base, and the driving sleeve is sleeved with the connecting sleeve.

Furthermore, a third rolling component is disposed between the driving sleeve and the connecting sleeve.

Furthermore, an axis of the third rolling component and an axis of the second rolling component are located in a straight line.

Furthermore, the driving sleeve includes a sleeve body and a turbine, the turbine is fixed at a bottom of the sleeve body.

Furthermore, the driving mechanism further includes a worm screw and a driving motor. The worm screw is engaged with the turbine, and the driving motor is configured to drive the worm screw to rotate.

Furthermore, a fixing base is disposed in the mounting cover, the worm screw is disposed on the fixing base, and damping sleeves are disposed between two ends of the worm screw and the fixing base.

Furthermore, the driving motor is fixedly connected to an inner cavity of the mounting cover, and a damping pad is disposed between the driving motor and the mounting cover.

Furthermore, a through hole is defined on the connecting component, and the through hole is located outside the connecting groove. The lifting component further includes a lifting rod, the lifting rod is disposed at an end portion of the lifting cylinder, and the lifting rod passes through the through hole to extend out of the mounting cover.

Furthermore, the fixing base is located below the lifting cylinder, and an elastic component is disposed between the fixing base and the lifting cylinder.

Furthermore, the vertical reciprocating motion mechanism further includes a lifting cover, the lifting cover covers the mounting cover and is connected to the lifting component, and the supporting device is disposed on the lifting cover.

Furthermore, a third gap exists between the lifting cover and the mounting cover, a limiting assembly is disposed between the lifting cover and the mounting cover.

Furthermore, the limiting assembly includes at least three first sliders, the at least three first sliders are disposed in an inner cavity of the lifting cover, and the at least three first sliders are disposed around the mounting cover and abut against an outer wall of the mounting cover.

Furthermore, the limiting assembly includes at least three second sliders, the at least three second sliders are disposed on an outer peripheral wall of the mounting cover, and the at least three second sliders abut against an inner wall of the lifting cover.

Furthermore, at least three first limiting grooves are defined on the outer wall of the mounting cover with respect to the at least three first sliders, and the at least three first sliders are capable of being respectively and movably clamped in the at least three first limiting grooves.

Furthermore, at least three second limiting grooves are defined on the inner wall of the lifting cover with respect to the at least three second sliders, and the at least three second sliders are capable of being respectively and movably clamped in the at least three second limiting grooves.

Furthermore, the limiting assembly further includes at least three second sliders, the at least three second sliders are disposed on an outer peripheral wall of the mounting cover, the at least three first sliders and the at least three second sliders are disposed at intervals, and the at least three second sliders abut against the inner cavity of the lifting cover. When the lifting cover is located at a lowest point, the at least three second sliders are located above the at least three first sliders.

Furthermore, the child care apparatus further includes a safety cover, the safety cover covers the lifting cover, a fourth gap exists between the safety cover and the lifting cover, and the safety cover is fixedly connected to the mounting cover. When the lifting cover rises to a highest position, a bottom of the lifting cover is located below a top of the safety cover.

Furthermore, a fifth gap exists between a hole wall of the through hole and the lifting rod.

Furthermore, the child care apparatus further includes a mounting base, the mounting base includes a bottom plate and supporting bases, and the supporting bases are disposed at two sides of the bottom plate. The horizontal reciprocating motion mechanism includes at least two rails, and the at least two rails are respectively disposed between two of the supporting bases. A sixth gap exists between adjacent two of the at least two rails, the mounting cover is movably connected to the at least two rails, and a seventh gap exists between the mounting cover and the bottom plate.

Furthermore, the mounting cover includes at least two rolling assemblies, the at least two rolling assemblies are disposed at two sides of the mounting cover, and the mounting cover is movably connected to the at least two rails through the at least two rolling assemblies.

Furthermore, four rolling assemblies are provided, first two of the four rolling assemblies are disposed at a first side of the mounting cover, and second two of the four rolling assemblies are disposed at a second side of the mounting cover.

Furthermore, each of the at least two rolling assemblies includes two rollers, the two rollers are oppositely disposed, each of the at least two rails is located between the two rollers and abuts against the two rollers.

Furthermore, rail grooves are defined at two sides of each of the at least two rails, the rail grooves are disposed in a length direction of each of the at least two rails, and the two rollers are clamped in the rail grooves.

Furthermore, the horizontal reciprocating motion mechanism further includes a power mechanism, the power mechanism is connected to the mounting cover and the bottom plate, and the power mechanism is configured to drive the mounting cover to reciprocate back and forth in the length direction of each of the at least two rails.

Furthermore, the power mechanism includes a driving disc, a sliding block, a sliding groove, and a power source. The sliding block is eccentrically disposed on a disc surface of the driving disc, the sliding groove and the power source are disposed on the bottom plate, the power source is disposed in the mounting cover, the power source is connected to the driving disc, and the sliding block is movably clamped in the sliding groove.

Furthermore, the sliding groove is strip-shaped, and the sliding groove is perpendicular to each of the at least two rails.

Based on above, the present disclosure has following beneficial effects.

Compared with the prior art, the present disclosure provides the child care apparatus including the horizontal reciprocating motion mechanism and the vertical reciprocating motion mechanism, the horizontal reciprocating motion mechanism and the vertical reciprocating motion mechanism enable the supporting device to reciprocate back and forth in at least two dimensions. When the supporting device supports infants and toddlers, the child care apparatus is capable of effectively imitating movements of caregivers of the infants and the toddlers when caring the infants and the toddlers, on one hand, the child care apparatus pacifies and pleases the infants and the toddlers, on another hand, the child care apparatus reduces pressure of the caregivers of the infants and the toddlers, which is worthy of popularization. When the vertical reciprocating motion mechanism drives the supporting device to do vertical reciprocating motion, since the mounting cover limits the lifting component to rotate, friction is generated between the mounting cover and the lifting component, but noise generated by the friction is small, so that influence of the noise on the infants and the toddlers is reduced, and experience of caring the infants and the toddlers of the caregivers of the infants and the toddlers is improved.

The lifting cylinder is sleeved with the driving sleeve, so that the lifting cylinder is driven by the driving sleeve to do the vertical reciprocating motion. The driving sleeve includes the driving grooves, and each of the driving grooves may be the threaded groove or the annular groove having the slope, and when the driving grooves are threaded grooves, the driving sleeve reciprocates back and forth in two directions to drive the lifting cylinder to do the vertical reciprocating motion; and when the driving grooves are annular grooves having slopes, the driving sleeve rotates in one direction to drive the lifting cylinder to do the vertical reciprocating motion. When the driving grooves are annular grooves, in order to improve balance and stability of lifting motion of the lifting cylinder and reduce noise, the at least two driving grooves are provided, and the lifting cylinder respectively includes the at least two sliding components, adjacent two of the at least two sliding components are located at two sides of the lifting cylinder, and the at least two sliding components are respectively clamped in the at least two driving grooves. In order to reduce friction between the at least two driving grooves and the at least two sliding components, the at least two sliding components may be rollers or bearings, thereby further reducing noise.

The at least one first rolling component is disposed between the lifting cylinder and the fixing shaft, and the at least one rolling component is a linear bearing. On one hand, sliding friction between the lifting cylinder and the fixing shaft is changed into rolling friction so as to reduce noise, and on another hand, the axis of the lifting cylinder and the axis of the fixing shaft are located on the same straight line, so that noise between the lifting cylinder and the fixing shaft is further reduced. The second rolling component is disposed between the driving sleeve and the connecting component of the mounting cover, and the second rolling component is a bearing, so that sliding friction between the driving sleeve and the connecting component of the mounting cover is changed into rolling friction to reduce friction, thereby reducing noise. The third rolling component is disposed between the driving sleeve and the connecting sleeve of the fixing base, the third rolling component is a bearing, and the third rolling component changes sliding friction between the driving sleeve and the connecting sleeve into rolling friction, so as to reduce friction, thereby reducing noise. Since the axis of the second rolling component and the axis of the third rolling component are located in the same straight line, the axis of the second rolling component and the axis of the first rolling component are located in the same straight line, the axis of the lifting cylinder, the axis of the driving sleeve, and the axis of the fixing shaft are located in the same straight line, on one hand, stability and balance of the driving sleeve driving the lifting cylinder to do the vertical reciprocating motion are improved to reduce noise, and on another hand, energy of the driving sleeve consumed in a process that the driving sleeve drives the lifting cylinder to do the vertical reciprocating motion may be effectively reduced, which saves energy.

The lifting rod passes through the through hole and extends out of the mounting cover, and the through hole is located outside the connecting groove, so that the mounting cover limits the rotation of the lifting cylinder through the through hole and the lifting rod. The limiting assembly is disposed between the mounting cover and the lifting cover, on one hand, the limiting assembly limits the lifting cover to rotate with respect to the mounting cover, thereby limiting the rotation of the lifting cylinder, so that the lifting cylinder and the lifting cover may only do the vertical reciprocating motion; on another hand, the limiting assembly changes sliding friction between the lifting cover and the mounting cover into rolling friction so as to reduce noise. Since the limiting assembly includes the at least three first sliders and the at least three second sliders, the at least three first sliders and the at least three second sliders are located between the lifting cover and the mounting cover, the at least three first sliders and the at least three second sliders are disposed at intervals, and each of the at least three second sliders is located above each of the at least three first sliders, so that the lifting cover and the lifting component do the vertical reciprocating motion with respect to the mounting cover, and the experience of caring the infants and the toddlers of the caregivers of the infants and the toddlers is improved. Moreover, since the fifth gap exists between the hole wall of the through hole and the lifting rod, friction between the through hole and the lifting rod is reduced, which is beneficial to reducing noise.

The elastic component is disposed between the fixing base and the lifting cylinder, when the lifting cylinder rises upward, the elastic component pushes the lifting cylinder to move upward, so as to reduce energy consumption; when the lifting cylinder is lowered down, on one hand, the elastic component plays a role in buffering, so as to slow down a downward movement speed of the lifting cylinder, which is beneficial to improving balance and stability, on another hand, due to an action of the elastic component, a top groove wall of each of the at least two driving grooves abuts against each of the at least two sliding components, so that the driving sleeve drives the lifting cylinder to move downward. If there is no elastic component, on one hand, a problem that the downward movement speed of the lifting cylinder is too high appears, and the balance and the stability are poor, and on another hand, the at least two sliding components, for doing the vertical reciprocating motion, of the lifting cylinder, abut against a bottom groove wall of each of the at least two driving grooves, and there is no new intention. When the driving sleeve does not drive the lifting cylinder to rotate, there may a gap between the at least two sliding components and the top groove wall of each of the at least two driving grooves and a gap between the at least two sliding components and the bottom groove wall of each of the at least two driving grooves due to an effect of the elastic component.

Furthermore, when the driving motor suddenly stops moving, the worm screw still drives the turbine to rotate due to inertia, and the lifting cylinder has a downward movement trend under an action of gravity, so that the lifting cylinder has a trend of driving the driving sleeve to rotate, and the elastic component limits the lifting cylinder to move downward, so that the turbine and the worm screw are automatically self-locked to limit rotation of the driving sleeve, thereby improving the stability and the balance, and a situation that the infants are frightened due to sudden stop work of the driving motor is reduced, so that user experience is improved.

The mounting cover clamps the at least two rails through the two rollers, on one hand, balance and stability of the mounting cover doing horizontal reciprocating motion are improved, so that noise is reduced; on another hand, the two rollers are prevented from being separated with the at least two rails to keep in contact with the at least two rails, thereby ensuring the balance and stability of the mounting cover doing the horizontal reciprocating motion, so that noise is reduced. In addition, friction between the two rollers and the at least two rails is reduced to reduce noise. The driving disc drives the sliding block to slide in the sliding groove, so that the mounting cover is driven to move on the at least two rails, and a moving speed of the mounting cover may be controlled by controlling a rotation speed of the driving disc, which is convenient for controlling the mounting cover to stably do horizontal motion.

The safety cover covers the lifting cover, the fourth gap exists between the safety cover and the lifting cover, so as to reduce friction between the lifting cover and the safety cover, thereby reducing noise. When the lifting cover rises to the highest position, the bottom of the lifting cover is located below the top of the safety cover, so as to prevent the infants and the toddlers from being damaged by the lifting cover when the lifting cover does lifting motion, thereby enhancing a safety factor of the child care apparatus.

For a better understanding and implementation, the present disclosure is described in detail below in conjunction with accompanying drawings.

BRIEF DESCRIPTION OF DRAWINGS

The drawings are for illustrative purposes only and are not to be construed as limiting the present disclosure. In order to better illustrate embodiments of the present disclosure, some components of the drawings may be omitted, enlarged or reduced, and do not represent a size of an actual product. For those who skilled in the art, it may be understood that some well-known structures and descriptions thereof in the drawings may be omitted.

Figure 1:
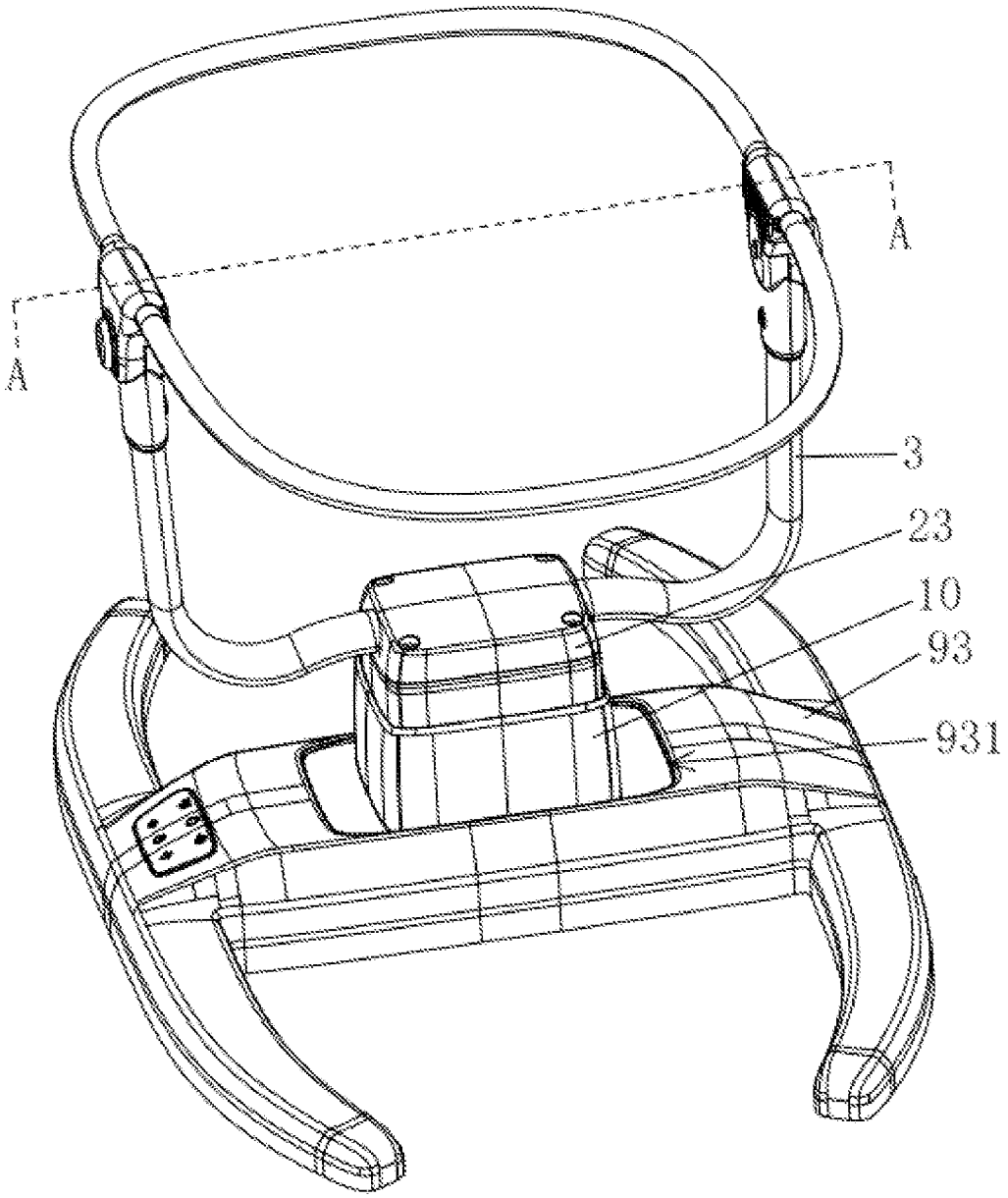
FIG. 1 is a structural schematic diagram of a child care apparatus according to one embodiment of the present disclosure.

Reference numerals in the drawings: 1. horizontal reciprocating motion mechanism; 11. mounting cover; 111. fixing shaft; 112. fixing base; 1121. connecting sleeve; 113. connecting component; 1131. through hole; 12. rail; 121. rail groove; 13. roller assembly; 131. roller; 14. power mechanism; 141. driving disc; 142. sliding block; 143. sliding groove; 44. power source; 145. power motor; 146. gearbox; 2. vertical reciprocating motion mechanism; 21. lifting component; 211. lifting cylinder; 2111. sliding component; 212. lifting rod; 22. driving mechanism; 221. driving sleeve; 2211. driving groove; 2212. sleeve body; 2213. turbine; 222. worm screw; 223. driving motor; 23. lifting cover; 3. supporting device; 4. first rolling component; 5. second rolling component; 6. six rolling component; 7. elastic component; 8. limiting assembly; 81. first slider; 82 second slider; 83. first limiting groove; 9. mounting base; 91. bottom plate; 92. supporting base; 93. cover cap; 931. movable hole; 10. safety cover.

DETAILED DESCRIPTION

Orientation terms, such as upper, lower, left, right, front, rear, front portion, rear portion, top, bottom, etc., mentioned or may be mentioned in the specification are defined with respect to their construction, which are relative terms and are possible to be correspondingly changed according to different positions thereof and different use states. Therefore, these or other orientation terms should also not be construed as limiting words.

Embodiments described in following exemplary embodiments do not represent all implementations consistent with the present disclosure. Rather, the embodiments are merely examples of implementations consistent with some aspects of the present disclosure.

Terminologies used in the present disclosure are for a purpose of describing particular embodiments only and is not intended to be limiting of the present disclosure. As used in the present disclosure, singular forms "a", "the", and "the" are also intended to include most forms unless the context clearly indicates other meanings. It should also be understood that the term "and/or" as used herein refers to and includes any or all possible combinations of one or more associated listed items.

The present disclosure is further described in detail below with reference to accompanying drawings.

As shown in FIGS. 1-7, the present disclosure provides a child care apparatus, including a horizontal reciprocating motion mechanism 1, a vertical reciprocating motion mechanism 2, a supporting device 3, and a mounting base 9. The horizontal reciprocating motion mechanism 1 is disposed on the mounting base 9, the vertical reciprocating motion mechanism 2 is disposed on the horizontal reciprocating motion mechanism 1, and the supporting device 3 is disposed on the vertical reciprocating motion mechanism 2, which may not only drive the supporting device 3 to independently do horizontal reciprocating motion or independently do vertical reciprocating motion, but also may drive the supporting device 3 to simultaneously do the horizontal reciprocating motion and the vertical reciprocating motion, which is beneficial to improving experience of caring infants and toddlers of caregivers of the infants and the toddlers. The horizontal reciprocating motion mechanism 1 includes a mounting cover 11. The vertical reciprocating motion mechanism 2 is disposed at the mounting cover 11. The vertical reciprocating motion mechanism 2 includes a lifting component 21 and a driving mechanism 22 for driving the lifting component 21 to move, the lifting component 21 is located in the mounting cover 11 and passes through the mounting cover 11 to extend out of the mounting cover 11, and the mounting cover 11 is configured to limit rotation of the lifting component 21. The supporting device 3 is located outside the mounting cover 11 and is disposed on the lifting component 21. Compared with the prior art, the present disclosure provides the child care apparatus including the horizontal reciprocating motion mechanism 1 and the vertical reciprocating motion mechanism 2, the horizontal reciprocating motion mechanism 1 and the vertical reciprocating motion mechanism 2 enable the supporting device 3 to reciprocate back and forth in at least two dimensions. When the supporting device 3 supports the infants and the toddlers, the child care apparatus is capable of effectively imitating movements of the caregivers of the infants and the toddlers when caring the infants and the toddlers, on one hand, the child care apparatus pacifies and pleases the infants and the toddlers, on another hand, the child care apparatus reduces pressure of the caregivers of the infants and the toddlers, which is worthy of popularization. When the vertical reciprocating motion mechanism 2 drives the supporting device 3 to do the vertical reciprocating motion, since the mounting cover 11 limits the lifting component 21 to rotate, friction is generated between the mounting cover 11 and the lifting component 21, but noise generated by the friction is small, so that influence of the noise on the infants and the toddlers is reduced, and experience of caring the infants and the toddlers of the caregivers of the infants and the toddlers is improved.

Figure 2:
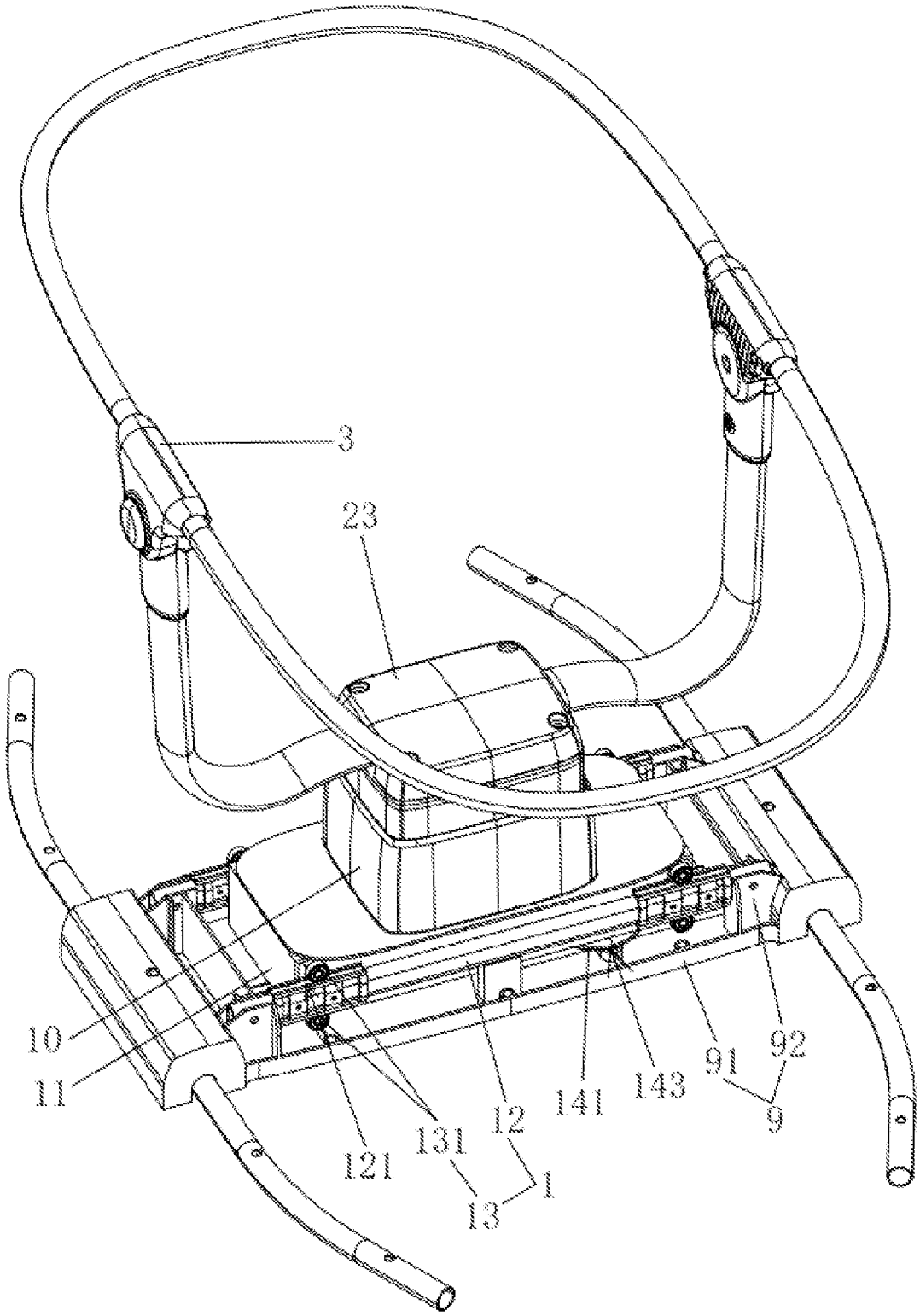
FIG. 2 is a structural schematic diagram of the child care apparatus according to one embodiment of the present disclosure, where a cover is removed.

In some embodiments, the lifting component 21 includes a lifting cylinder 211 and a lifting rod 212, and the lifting rod 212 are disposed at an end portion of the lifting cylinder 211. As shown in FIG. 2, the lifting rod 212 is located at a top of the lifting cylinder 211. The driving mechanism 22 includes a driving sleeve 221 a driving rod, and a driving motor 223, the driving rod is configured to drive the driving sleeve 221 to rotate, the driving motor 223 is configured to drive the driving rod to rotate, the driving sleeve 221 is sleeved with the lifting cylinder 211, and the driving sleeve 221 is capable of being sleeved on the lifting cylinder 211. Certainly, the lifting cylinder 211 may also be sleeved on the driving sleeve 221, and those who skilled in the art may set according to requirements. If the lifting cylinder 211 is sleeved on the driving sleeve 221, since the driving sleeve 221 is connected to the driving rod, compared with that the driving sleeve 221 is sleeved on the lifting cylinder 211, a length of the driving sleeve 221 becomes longer, so that a height of the child care apparatus is increased, and the child care apparatus needs to occupy a larger space, which is not beneficial to packaging and transportation. Therefore, in the present disclosure, the driving sleeve 221 is sleeved on the lifting cylinder 211 to describe the present disclosure, and the lifting cylinder 211 is sleeved on the driving sleeve 221, which should also be a point and protection scope of the present disclosure.

Furthermore, the driving sleeve 221 includes driving grooves 2211, and the lifting cylinder 211 includes sliding components 2111, the sliding components 2111 may also be disposed in the driving sleeve 221, and the at least two driving grooves 2211 may also be disposed in the lifting cylinder 211, that is, how to set the at least two driving grooves 2211 and the sliding components 2111 may be determined by those who skilled in the art according to requirements. In the present disclosure, since the driving sleeve 221 is sleeved on the lifting cylinder 211, the at least two driving grooves 2211 are defined on an inner wall of the driving sleeve 221, the sliding components 2111 are disposed on an outer wall of the lifting cylinder 211, the sliding components 2111 are movably clamped in the at least two driving grooves 2211, and the driving sleeve 221 drives the lifting cylinder 211 to rotate through the at least two driving grooves 2211 and the sliding components 2111, since the mounting cover 11 limits rotation of the lifting cylinder 211, the lifting cylinder 211 reciprocates back and forth in a vertical direction. The at least two driving grooves 2211 may be threaded grooves, and the threaded grooves are defined in a circumferential inner wall of the driving sleeve 221, and when the at least two driving grooves 2211 are the threaded grooves, the driving sleeve 221 rotates in a first direction to drive the lifting cylinder 211 to vertically move upward, and the driving sleeve 221 rotates in a second direction to drive the lifting cylinder 211 to vertically move downward. The at least two driving grooves 2211 may also be annular grooves having slopes, that is, the at least two driving grooves 2211 are obliquely disposed in the driving sleeve 221, and the annular grooves having the slopes are disposed on the circumferential inner wall of the driving sleeve 221. When the at least two driving grooves 2211 are the annular grooves having the slopes, in order to improve balance and stability of the lifting cylinder 211 doing the vertical reciprocating motion and reduce noise, at least two driving grooves 2211 are provided, and at least two sliding components 2111 are provided with respect to the at least two driving grooves 2211. The at least two sliding components 2111 are respectively clamped in the at least two driving grooves 2211. When the driving sleeve 221 rotates, the driving sleeve 211 drives the at least two sliding components 2111 through the at least two driving grooves 2211. A lowest point of a first driving groove 2211 in the at least two driving grooves 2211 is located above a highest point of a second driving groove 2211 in the at least two driving grooves 2211, where the first driving groove 2211 is adjacent to the second driving groove 2211; or, a highest point of the second driving groove 2211 in the at least two driving grooves 2211 is located above a lowest point of the first driving groove 2211 in the at least two driving grooves 2211, where the second driving groove 2211 is adjacent to the first driving groove 2211, so that the at least two sliding components 2111 are respectively disposed at two sides of the lifting cylinder 211. As shown in FIG. 2, adjacent two of the at least two sliding components 2111 are located at two sides of the lifting cylinder 211, and a first sliding component 2111 in the adjacent two of the at least two sliding components 2111 is located above a second sliding component 2111 in the adjacent two of the at least two sliding components 2111. In order to reduce costs, as shown in FIG. 2, two driving grooves 2211 are provided, and two sliding components 2111 are further provided with respect to the two sliding grooves 2211, the two sliding components 2111 are respectively clamped in the two driving grooves 2211, and in order to reduce friction, the at least two sliding components 2111 may be bearing wheels or other suitable wheels.

In some embodiments, a fixing shaft 111 and a fixing base 112 are disposed in the mounting cover 11, the fixing base 112 is fixedly connected to a bottom of the mounting cover 11, the fixing base 112 is located below the fixing shaft 111, and two ends of the fixing shaft 111 are respectively and fixedly connected to the fixing base 112 and the mounting cover 11, so that the mounting cover 11, the fixing shaft 111, and the fixing base 112 are relatively fixed. The lifting cylinder 211 is sleeved on the fixing shaft 111, and at least one first rolling component 4 is disposed between the lifting cylinder 211 and the fixing shaft 111. Sliding friction between the lifting cylinder 211 and the fixing shaft 111 is changed into rolling friction by the at least one first rolling component 4, so that on one hand, noise is reduced, and on another hand, energy consumed for driving the lifting cylinder 211 to move is achieved. Two first rolling components 4, a gap exists between the two first rolling components 4, and the two first rolling components 4 drive an axis of the lifting cylinder 211 and an axis of the fixing shaft 111 to be located on the same straight line, which is beneficial to optimizing stability and balance of movements of the lifting cylinder 211 with respect to the fixing shaft 111, so as to reduce noise. The at least one rolling component 4 may be a linear bearing, certainly, the at least one rolling component may also be other suitable rolling components.

In some embodiments, a connecting component 113 is disposed at a top of an inner cavity of the mounting cover 11, a connecting groove is defined on the connecting component 113, an opening of the connecting groove faces the fixing base 112, and the fixing shaft 111 is inserted into the connecting groove and is fixedly connected to the connecting groove, so as to fixedly connect the fixing shaft 111 with the mounting cover 11. The driving sleeve 221 is located in the mounting cover 11. A first gap exists between an outer wall of the driving sleeve 221 and the inner cavity of the mounting cover 11, and a second gap exists between a top of the driving sleeve 221 and the inner cavity of the mounting cover 11, so as to limit the outer wall of the driving sleeve 221, the top of the driving sleeve 221, and the inner cavity the mounting cover 11 to generating friction, so as to reduce noise and energy consumed for driving the driving sleeve 221 to rotate. A second rolling component 5 is disposed between the driving sleeve 221 and the connecting component 113, the second rolling component 5 may be a bearing, the second rolling component 5 may also be other suitable rolling components, and the fixing shaft 111 is located in the second rolling component 5. The second rolling component 5 changes sliding friction between the driving sleeve 221 and the connecting component 113 into rolling friction, so as to reduce friction between the driving sleeve 221 and the connecting component 113, thereby reducing noise and energy consumption. A connecting sleeve 1121 is disposed on the fixing base 112, and the driving sleeve 221 is sleeved with the connecting sleeve 1121, so that the driving sleeve 221 rotates with respect to the connecting sleeve 1121. The fixing base 112 include a connecting block, the connecting block is located in the connecting groove, an inserting groove is defined in the connecting block, and a center of the inserting groove and an axis of the connecting sleeve 1121 are located in the same straight line. The fixing shaft 111 is inserted into the inserting groove and is fixedly connected to the inserting groove, so that the fixing shaft 111 is fixedly connected with the fixing base 112. A third rolling component 6 is disposed between the driving sleeve 221 and the connecting sleeve 1121, and the third rolling component 6 is a bearing, certainly, the third rolling component 6 may also be other suitable rolling components, and the third rolling component 6 changes sliding friction between the driving sleeve 221 and the connecting sleeve 1121 into rolling friction. On one hand, the driving sleeve 221 is more balanced and stable when rotating with respect to the connecting sleeve 1121, so as to reduce noise, and on another hand, the driving sleeve 221 counteracts a force required for friction between the driving sleeve 221 and the connecting sleeve 1121 to reduce energy consumption.

Furthermore, an axis of the first rolling component 4 and an axis of the second rolling component 5 are located in the same straight line, the axis of the second rolling component 5 and an axis of the third rolling component 6 are located in the same straight line, so that the axis of the first rolling component 4, the axis of the second rolling component 5, and the axis of the third rolling component 6 are located in the same straight line, thereby locating the axis of the fixing shaft 111, the axis of the first rolling component 4, the axis of the lifting cylinder 211, and an axis of the driving sleeve 221 are located in the same straight line, so as to optimize the stability and balance of the driving sleeve 221 driving the lifting cylinder 211 to move, and further reduce noise. In addition, a force required for the driving sleeve 221 to drive the lifting cylinder 211 to move may further be reduced, so as to reduce energy consumption.

In some embodiments, the driving sleeve 221 includes a sleeve body 2212 and a turbine 2213, the turbine 2213 is fixed at a bottom of the sleeve body 2212, the at least two driving grooves 2211 are disposed on the sleeve body 2212, and the turbine 2214 is sleeved with the connecting sleeve 1121 through the third rolling component 6. The driving rod is a worm screw 222, the worm screw 222 is mounted on the fixing base 112, and the worm screw 222 is engaged with the turbine 2213. In order to reduce vibration between the worm screw 222 and the fixing base 112, damping sleeves are disposed between two ends of the worm screw 222 and the fixing base 112, and the damping sleeves absorb vibration generated by rotation of the worm screw 222 to reduce noise. In addition, since the damping sleeves have elasticity, the damping sleeves may further adjust an engaging connection state between the worm screw 222 and the turbine 2213, so that the engaging connection state between the worm screw 222 and the turbine 2213 is optimal, which is convenient for the worm screw 222 to drive the turbine 2213 to rotate. The driving motor 223 is fixedly connected to the inner cavity of the mounting cover 11, and in order to reduce vibration between the driving motor 223 and the mounting cover 11, a damping pad is disposed between the driving motor 223 and the inner cavity of the mounting cover 11, and the damping pad absorbs vibration generated when the driving motor 223 works. The driving motor 223 is connected to the worm screw 222 through a transmission component, so as to drive the worm screw 222 to rotate. The transmission component may be two gears which are engaged, and the two gears are respectively connected to the driving motor 223 and the worm screw 222. The transmission component may also include two belt wheels and a belt connected between the two belt wheels, and the two belt wheels are respectively connected to the worm screw 222 and a motor. The transmission component may further be two chain wheels and a chain connected between the two chain wheels, and the two chain wheels are respectively connected to the worm screw 222 and the motor.

In some embodiments, an elastic component 7 is disposed between the fixing shaft 111 and the lifting cylinder 211, the elastic component 7 may be a compression spring, and the elastic component 7 is located between the fixing shaft 111 and the connecting sleeve 1121 to limit displacement of the elastic component 7. A groove for clamping with the elastic component 7 is defined at the end portion of the lifting cylinder 211, and the elastic component 7 is clamped into the groove to limit the displacement of the elastic component 7. As shown in FIG. 2, a distance from a top of each of the at least two driving grooves 2211 to a bottom of each of the at least two driving grooves 2211 is greater than a vertical height of each of the at least two sliding components 2111, when the at least two sliding components 2111 are wheels, the distance from the top of each of the at least two driving grooves 2211 to the bottom of each of the at least two driving grooves 2211 is greater than a diameter of each the at least two sliding components 2111. When the driving sleeve 221 drives the lifting cylinder 211 to move upward through the at least two driving grooves 2211, a bottom groove wall of each of the at least two driving grooves 2211 abuts against each of the at least two sliding components 2111; and when the driving sleeve 221 drives the lifting cylinder 211 to move downward through the at least two driving grooves 2211, a top groove wall of each of the at least two driving grooves 2211 abuts against the at least two sliding components 2111 due to an action of the elastic component 7. When the lifting cylinder 211 rises upward, the elastic component 7 pushes the lifting cylinder 211 to move upward, so as to reduce energy consumption; when the lifting cylinder 211 is lowered down, on one hand, the elastic component 7 plays a role in buffering, so as to slow down a downward movement speed of the lifting cylinder 211, which is beneficial to improving balance and stability, on another hand, due to the action of the elastic component 7, the top groove wall of each of the at least two driving grooves 2211 abuts against each of the at least two sliding components 2111, so that the driving sleeve 221 drives the lifting cylinder 211 to move downward. If there is no elastic component 7, on one hand, a problem that the downward movement speed of the lifting cylinder 211 is too high appears, and the balance and the stability are poor, and on another hand, the at least two sliding components 2111, for doing the vertical reciprocating motion, of the lifting cylinder 211, abut against the bottom groove wall of each of the at least two driving grooves 2211, and there is no new intention. When the driving sleeve 221 does not drive the lifting cylinder 211 to rotate, there may a gap between the at least two sliding components 2111 and the top groove wall of each of the at least two driving grooves 2211 and a gap between the at least two sliding components 2111 and the bottom groove wall of each of the at least two driving grooves 2211 due to an effect of the elastic component 7.

In other embodiments, at least one through hole 1131 is defined on the connecting component 113, the at least one through hole 1131 is located outside the connecting groove 113, and the lifting rod 212 passes through the at least one through hole 1131 and extends out of the mounting cover 11. The at least one through hole 1131 limits rotation of the lifting rod 212, so as to limit the rotation of the lifting cylinder 211. In the present disclosure, the at least one through hole 1131 preferably limits the rotation of the lifting rod 212, thereby limiting the friction between a hole wall of the at least one through hole 1131 and the lifting rod 212.

Furthermore, the vertical reciprocating motion mechanism 2 further includes a lifting cover 23, the lifting cover 23 covers the mounting cover 11 and is connected to the lifting component 21, that is, the lifting cover 23 is connected to a top of the lifting rod 212. When the lifting cylinder 211 moves up and down, the lifting rod 212 moves along with the lifting cylinder 211, the lifting rod 212 drives the lifting cover 23 to move up and down, so that the lifting cover 23 reciprocates back and forth in a vertical direction, and the supporting device 3 is disposed on the lifting cover 23, so that the supporting device 3 reciprocates back and forth in the vertical direction. It should be noted that the supporting device 3 is configured to support the infants and the toddlers. A third gap exists between the lifting cover 23 and the mounting cover 11, a limiting assembly 8 is disposed between the lifting cover 23 and the mounting cover 11, and the limiting assembly 8 not only limits rotation of the lifting cover 23 with respect to the mounting cover 11, but also changes sliding friction between the lifting cover 23 and the mounting cover 11 into rolling friction, thereby improving the stability and balance of the lifting cover 23 during lifting motion, so as to reduce noise when the lifting cover 23 is lifted. Since the limiting assembly 8 limits the rotation of the lifting cover 23 with respect to the mounting cover 11, if a fifth gap exists between the hole wall of the at least one through hole 1131 and the lifting rod 212, friction generated between the lifting rod 212 and the hole wall of the at least one through hole 1131 may be limited to reduce energy consumption and noise.

Figure 6:
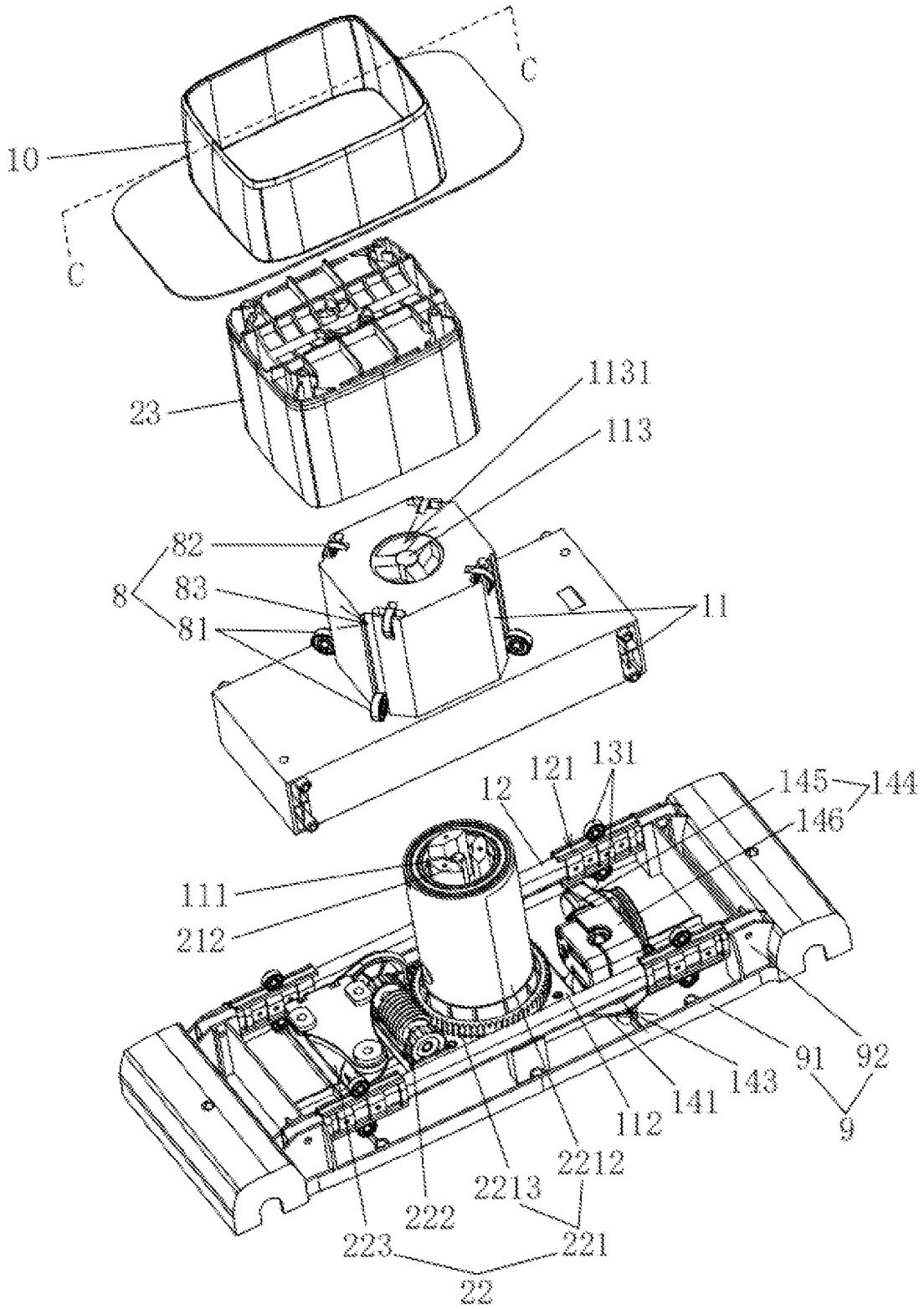
FIG. 6 is a schematic diagram of an exploded view of a horizontal reciprocating motion mechanism and a vertical reciprocating motion mechanism according to one embodiment of the present disclosure.
Figure 7:
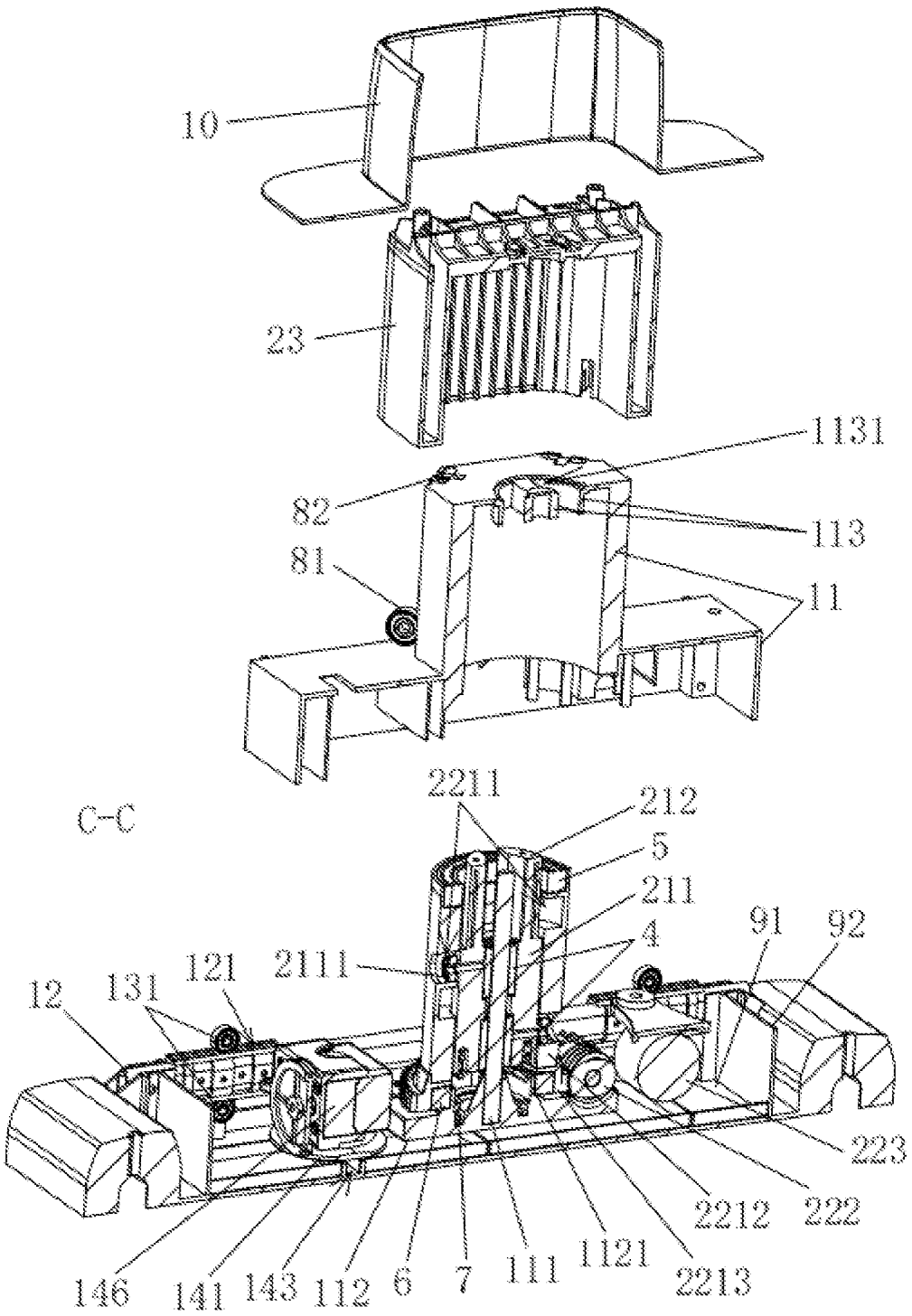
FIG. 7 is a schematic diagram of a cross-sectional view taken along line C-C shown in FIG. 6.

In some embodiments, the limiting assembly 8 includes at least three first sliders 81 and at least three second sliders 82, the at least three first sliders 81 are disposed in an inner cavity of the lifting cover 23, the at least three second sliders 82 are disposed on an outer peripheral wall of the mounting cover 11, the at least three first sliders 81 and the at least three second sliders 82 are disposed at intervals, the at least three first sliders 81 are disposed around the mounting cover 11 and abut against an outer wall of the mounting cover 11, and the at least three second sliders 82 abut against an inner wall of the lifting cover 23. It should be noted that the number of the at least three first sliders 81 and the at least three second sliders 82 may be set according to requirements, and when a cross section of the mounting cover 11 is circular, there may be three first sliders 81 and three second sliders 82. A shape of the Cross sections of the mounting cover 11 and the lifting cover 23 are at least polygons, for example, triangles, quadrangles, pentagons, etc. As shown in FIG. 6, a cross section of a portion, covered by the lifting cover 23, of the mounting cover 11 is octagonal, and a cross section of the lifting cover 23 is quadrilateral. At least three first limiting grooves 83 are defined on the outer wall of the mounting cover 11 with respect to the at least three first sliders 81, each of the at least three first limiting grooves 83 is strip-shaped, the at least three first limiting grooves 83 are parallel to the fixing shaft 111, and the at least three first sliders 81 are capable of being respectively and movably clamped in the at least three first limiting grooves 83. On one hand, the sliding friction between the lifting cover 23 and the mounting cover 11 is changed into the rolling friction, and on another hand, the lifting cover 23 is limited to rotate with respect to the mounting cover 11. At least three second limiting grooves are defined on the inner wall of the lifting cover 23 with respect to the at least three second sliders 82, each of the at least three second limiting grooves is strip-shaped, the at least three second limiting grooves are parallel to the fixing shaft 111, and the at least three second sliders 82 are capable of being respectively and movably clamped in the at least three second limiting grooves. On one hand, the sliding friction between the lifting cover 23 and the mounting cover 11 is changed into the rolling friction, and on another hand, the lifting cover 23 is limited to rotate with respect to the mounting cover 11. When the lifting cover 23 is located at a lowest point, the at least three second sliders 82 are located above the at least three first sliders 81, so that when the lifting cover 23 moves up and down, the at least three first sliders 81 and the at least three second sliders 82 are supported between the lifting cover 23 and the mounting cover 11, which is beneficial to improving balance and stability of the lifting cover 23 moving up and down, so as to reduce noise. The at least three first sliders 81 and the at least three second sliders 82 may be bearings or wheels, or other suitable sliders.

In some embodiments, in order to improve a safety factor of the child care apparatus, the child care apparatus further includes a safety cover 10. The safety cover 10 covers the lifting cover 23, a fourth gap exists between the safety cover 10 and the lifting cover 23, and the safety cover 10 is fixedly connected to the mounting cover 11. When the lifting cover 23 rises to a highest position, a bottom of the lifting cover 23 is located below a top of the safety cover 10. The safety cover 10 limits hands of users to put into a gap between the lifting cover 23 and the mounting cover 11, the gap is located between the bottom of the lifting cover 23 and the safety cover 11, so as to efficiently prevent the hands of the users from being damaged by the lifting cover 23.

Figure 3:
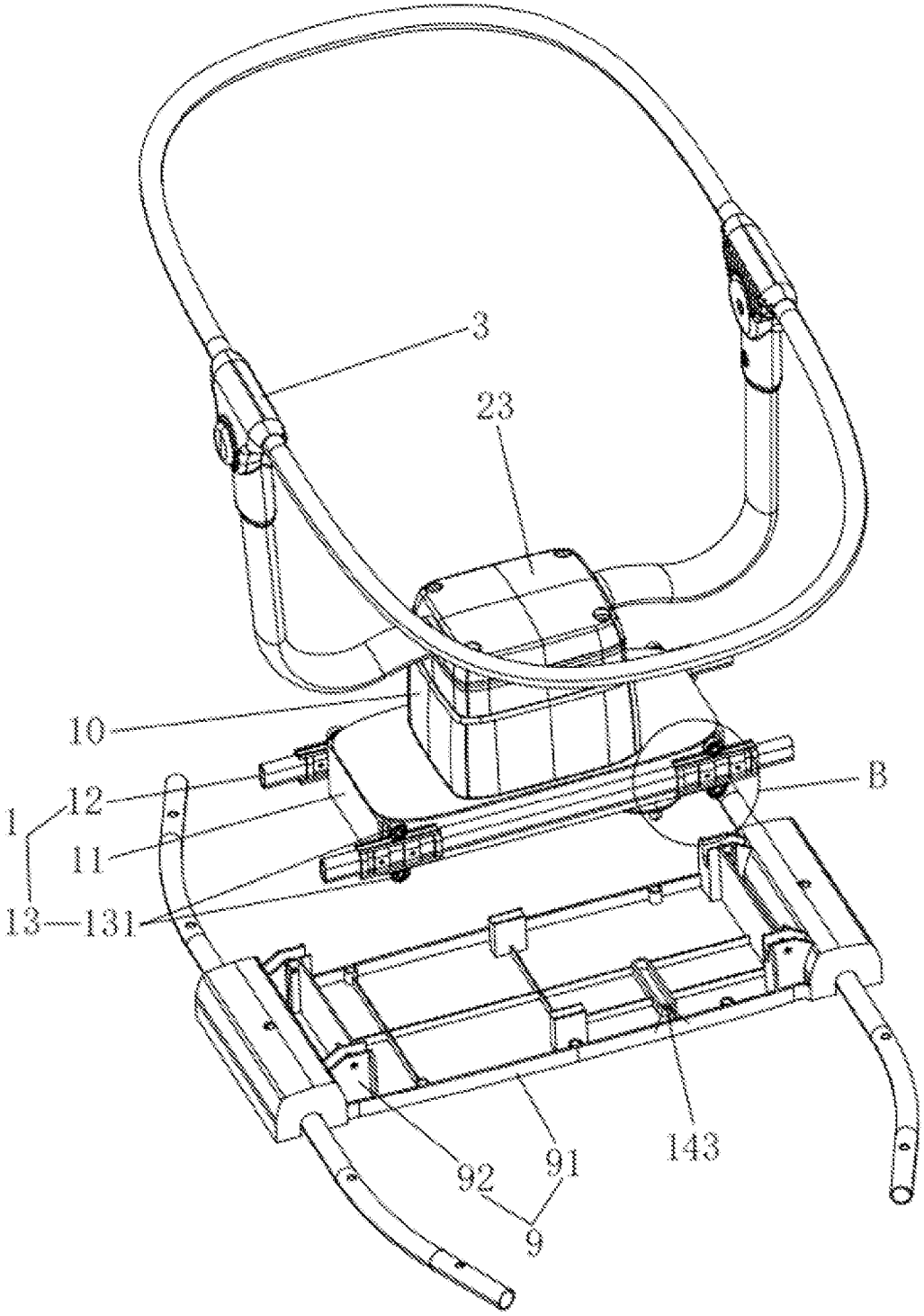
FIG. 3 is a schematic diagram of an exploded view of the child care apparatus shown in FIG. 2.
Figure 4:
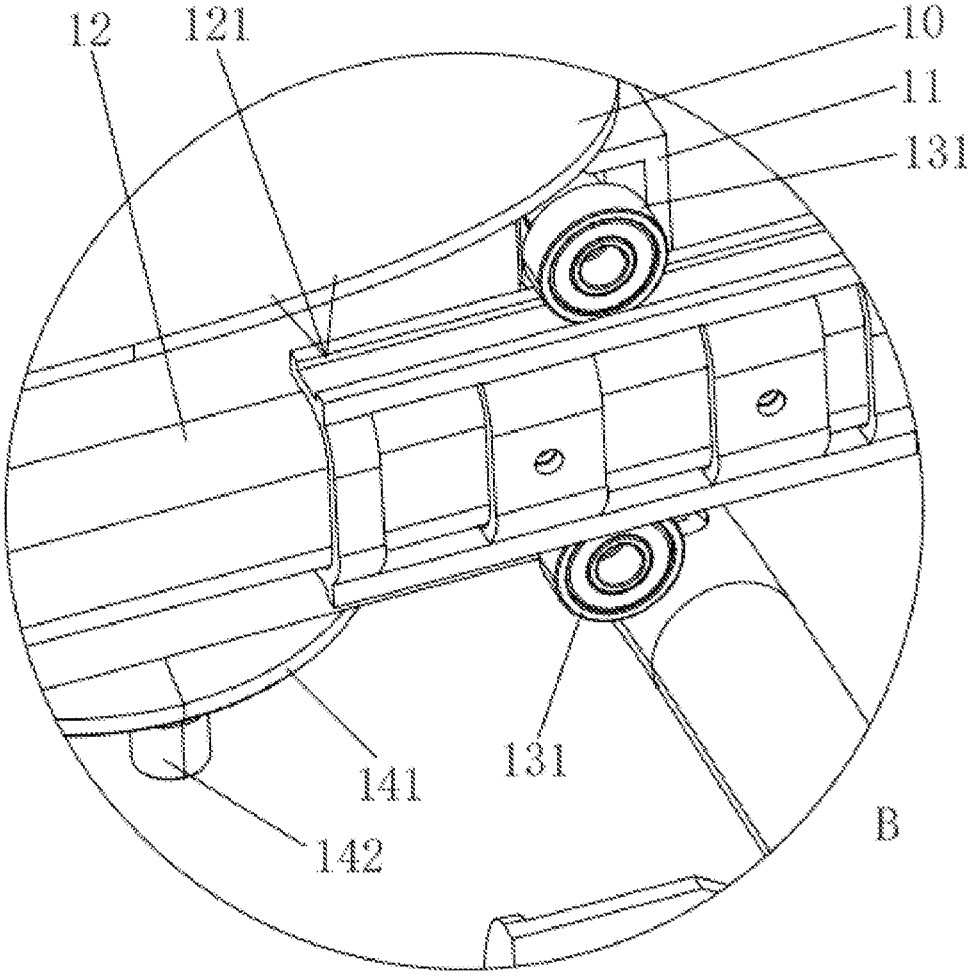
FIG. 4 is a schematic diagram of a partial enlarged view of portion B shown in FIG. 3.
Figure 5:
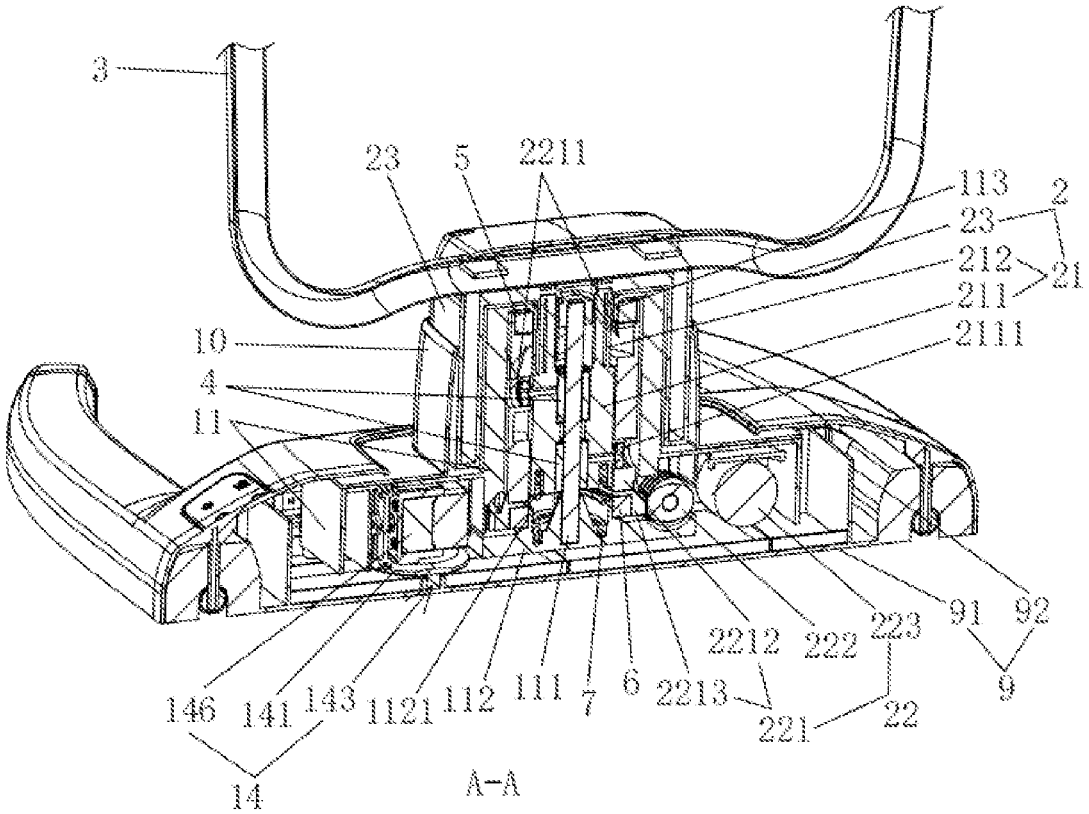
FIG. 5 is a schematic diagram of a cross-sectional view taken along the line A-A shown in FIG. 1.

In some embodiments, the mounting base 9 includes a bottom plate 91 and supporting bases 92, and the supporting bases 92 are disposed at two sides of the bottom plate 91. The horizontal reciprocating motion mechanism 1 includes at least two rails 12. As shown in FIGS. 2-3, two rails are provided, and the two rails 12 are disposed in parallel, and the two rails 12 are respectively disposed between two of the supporting bases 92. A sixth gap exists between adjacent two of the at least two rails 12, the mounting cover 11 is movably connected to the at least two rails 12, and a seventh gap exists between the mounting cover 11 and the bottom plate 91, so as to limit the bottom plate 91 and the mounting cover 11 to generate friction.

Furthermore, the mounting cover 11 includes at least two rolling assemblies 13, the number of the at least two rolling assemblies 13 may be set according to requirements. The at least two rolling assemblies 13 are disposed at two sides of the mounting cover 11, and the mounting cover 11 is movably connected to the at least two rails 12 through the at least two rolling assemblies 13. In order to improve balance and stability of the mounting cover 11 moving on the at least two rails, four rolling assemblies 13 are provided, first two of the four rolling assemblies 13 are disposed at a first side of the mounting cover 11, and second two of the four rolling assemblies 13 are disposed at a second side of the mounting cover 11. Each of the at least two rolling assemblies 13 includes two rollers 131, the two rollers 131 are oppositely disposed, a first roller 131 in the two rollers 131 is located above a second roller 131 in the two rollers 131, each of the at least two rails 12 is located between the two rollers 131 and abuts against the two rollers 131, so that the two rollers 131 clamp the at least two rails 12. On one hand, the mounting cover 11 is prevented from being removed from the at least two rails 12, and the two rollers 131 are further prevented from being removed from the at least two rails 12 when carrying the child care apparatus, so as to keep the two rollers 131 abutting against the at least two rails 12, and on another hand, reciprocating motion of the mounting cover 11 on the at least two rails 12 is more stable and balanced, so as to reduce noise. Rail grooves 121 are defined at two sides of each of the at least two rails 12, the rail grooves 121 are disposed along a length direction of each of the at least two rails 12, the two rollers 131 are clamped in the rail grooves 121, and the rail grooves 121 limit the two rollers 131 from removing from the at least two rails 12.

In some embodiments, the horizontal reciprocating motion mechanism 1 further includes a power mechanism 14, the power mechanism 14 is connected to the mounting cover 11 and the bottom plate 91, and the power mechanism 14 is configured to drive the mounting cover 11 to reciprocate back and forth in the length direction of each of the at least two rails 12. The power mechanism 14 includes a driving disc 141, a sliding block 142, a sliding groove 143, and a power source 144. The sliding block 142 is eccentrically disposed on a disc surface of the driving disc 141, the sliding groove 143 and the power source 144 are disposed on the bottom plate 91, the power source 144 is disposed in the mounting cover 11, the power source 144 is fixedly connected to the inner cavity of the mounting cover 11, the power source 144 is connected to the driving disc 141 and is configured to drive the driving disc 141 to rotate. The sliding block 142 is movably clamped in the sliding groove 143. When using the child care apparatus, the power source 144 drives the driving disc 141 to rotate, and the driving disc 141 drives the sliding block 142 to move back and forth in the sliding groove 143. Since the sliding groove 143 is defined on the bottom plate 91 and the bottom plate 91 is fixed, the mounting cover 11 is driven to move, so that the mounting cover 11 reciprocates back and forth in the length direction of each of the at least two rails 12. The power source 144 includes a power motor 145 and a gearbox 146, the power motor 145 and the gearbox 146 are both mounted in the inner cavity of the mounting cover 11, the power motor 145 is connected to the gearbox 146 through the transmission component, the transmission component may adopt the components mentioned above, the driving disc 141 is mounted at a bottom of the gearbox 146, and the power motor 145 drives the driving disc 141 to rotate through the gearbox 146, so as to drive the mounting cover 11 to reciprocate back and forth on the at least two rails 12. The sliding grooves 143 are strip-shaped, the sliding groove 143 may be set at an angle with the at least two rails 12 according to requirements, and the sliding groove is preferably perpendicular to each of the at least two rails.

In some embodiments, the child care apparatus further includes a cover cap 93, the cover cap 92 covers on the mounting base 9, so as to cover the mounting cover 11, the at least two rails 12, the mounting base 9, etc. for protecting the child care apparatus. A movable hole 931 is defined on the cover cap 93, and the safety cover 10 and the lifting cover 23 extend out of the cover cap 93 through the movable hole 931. The safety cover 10 may reciprocate back and forth in the movable hole 931 along with the mounting cover 11, so as to drive the supporting device 3 to do the horizontal reciprocating motion.

Embodiments of the present disclosure are preferred embodiments of the present disclosure, and are not intended to limit protection scopes of the present disclosure, and therefore, equivalent changes made according to the structure, shape, and principle of the present disclosure shall fall within the protection scopes of the present disclosure.

What is claimed is:

1. A child care apparatus, comprising:

a horizontal reciprocating motion mechanism;

a vertical reciprocating motion mechanism; and a supporting device;

wherein the horizontal reciprocating motion mechanism comprises a mounting cover; the vertical reciprocating motion mechanism is disposed at the mounting cover; the vertical reciprocating motion mechanism comprises a lifting component and a driving mechanism for driving the lifting component to move, the lifting component is located in the mounting cover and passes through the mounting cover to extend out of the mounting cover, and the mounting cover is configured to limit rotation of the lifting component; the supporting device is located outside the mounting cover and is disposed on the lifting component;

the lifting component comprises a lifting cylinder; the driving mechanism comprises a driving sleeve, and the driving sleeve is sleeved with the lifting cylinder;

a fixing shaft and a fixing base are disposed in the mounting cover, the fixing base is fixedly connected to a bottom of the mounting cover, the fixing base is located below the fixing shaft, and two ends of the fixing shaft are respectively and fixedly connected to the fixing base and the mounting cover;

the fixing base is located below the lifting cylinder, and an elastic component is disposed between the fixing base and the lifting cylinder.

2. The child care apparatus according to claim 1, wherein the driving sleeve comprises driving grooves, the lifting cylinder comprises sliding components, and the sliding components are movably clamped in the driving grooves.

3. The child care apparatus according to claim 2, wherein each of the driving grooves is a threaded groove or an annular groove having a slope.

4. The child care apparatus according to claim 3, wherein at least two driving grooves are provided, and at least two sliding components are provided with respect to the at least two driving grooves; the at least two sliding components are respectively clamped in the at least two driving grooves.

5. The child care apparatus according to claim 4, wherein a lowest point of a first driving groove in the at least two driving grooves is located above a highest point of a second driving groove in the at least two driving grooves, where the first driving groove is adjacent to the second driving groove; or, a highest point of the second driving groove in the at least two driving grooves is located above a lowest point of the first driving groove in the at least two driving grooves, where the second driving groove is adjacent to the first driving groove.

6. The child care apparatus according to claim 1, wherein the lifting cylinder is sleeved on the fixing shaft, and at least one first rolling component is disposed between the lifting cylinder and the fixing shaft.

7. The child care apparatus according to claim 6, wherein a connecting component is disposed at a top of an inner cavity of the mounting cover, a connecting groove is defined on the connecting component, and the fixing shaft is fixed in the connecting groove.

8. The child care apparatus according to claim 7, wherein the driving sleeve is located in the mounting cover; a first gap exists between an outer wall of the driving sleeve and the inner cavity of the mounting cover, and a second gap exists between a top of the driving sleeve and the inner cavity of the mounting cover; a second rolling component is disposed between the driving sleeve and the connecting component.

9. The child care apparatus according to claim 8, wherein an axis of the at least one first rolling component and an axis of the second rolling component are located in a straight line.

10. The child care apparatus according to claim 8, wherein a connecting sleeve is disposed on the fixing base, and the driving sleeve is sleeved with the connecting sleeve.

11. The child care apparatus according to claim 10, wherein a third rolling component is disposed between the driving sleeve and the connecting sleeve.

12. The child care apparatus according to claim 11, wherein an axis of the third rolling component and an axis of the second rolling component are located in a straight line.

13. The child care apparatus according to claim 1, wherein the driving sleeve comprises a sleeve body and a turbine, the turbine is fixed at a bottom of the sleeve body.

14. The child care apparatus according to claim 13, wherein the driving mechanism further comprises a worm screw and a driving motor; the worm screw is engaged with the turbine, and the driving motor is configured to drive the worm screw to rotate.

15. The child care apparatus according to claim 14, wherein a fixing base is disposed in the mounting cover, the worm screw is disposed on the fixing base, and damping sleeves are disposed between two ends of the worm screw and the fixing base.

16. The child care apparatus according to claim 14, wherein the driving motor is fixedly connected to an inner cavity of the mounting cover, and a damping pad is disposed between the driving motor and the mounting cover.

17. The child care apparatus according to claim 7, wherein a through hole is defined on the connecting component, and the through hole is located outside the connecting groove; the lifting component further comprises a lifting rod, the lifting rod is disposed at an end portion of the lifting cylinder, and the lifting rod passes through the through hole to extend out of the mounting cover.

18. The child care apparatus according to claim 1, wherein the vertical reciprocating motion mechanism further comprises a lifting cover, the lifting cover covers the mounting cover and is connected to the lifting component, and the supporting device is disposed on the lifting cover.

19. The child care apparatus according to claim 18, wherein a third gap exists between the lifting cover and the mounting cover, a limiting assembly is disposed between the lifting cover and the mounting cover.

20. The child care apparatus according to claim 19, wherein the limiting assembly comprises at least three first sliders, the at least three first sliders are disposed in an inner cavity of the lifting cover, and the at least three first sliders are disposed around the mounting cover and abut against an outer wall of the mounting cover.

21. The child care apparatus according to claim 19, wherein the limiting assembly comprises at least three second sliders, the at least three second sliders are disposed on an outer peripheral wall of the mounting cover, and the at least three second sliders abut against an inner wall of the lifting cover.

22. The child care apparatus according to claim 20, wherein at least three first limiting grooves are defined on the outer wall of the mounting cover with respect to the at least three first sliders, and the at least three first sliders are capable of being respectively and movably clamped in the at least three first limiting grooves.

23. The child care apparatus according to claim 21, wherein at least three second limiting grooves are defined on the inner wall of the lifting cover with respect to the at least three second sliders, and the at least three second sliders are capable of being respectively and movably clamped in the at least three second limiting grooves.

24. The child care apparatus according to claim 20, wherein the limiting assembly further comprises at least three second sliders, the at least three second sliders are disposed on an outer peripheral wall of the mounting cover, the at least three first sliders and the at least three second sliders are disposed at intervals, and the at least three second sliders abut against the inner cavity of the lifting cover; when the lifting cover is located at a lowest point, the at least three second sliders are located above the at least three first sliders.

25. The child care apparatus according to claim 18, wherein the child care apparatus further comprises a safety cover, the safety cover covers the lifting cover, a fourth gap exists between the safety cover and the lifting cover, and the safety cover is fixedly connected to the mounting cover; when the lifting cover rises to a highest position, a bottom of the lifting cover is located below a top of the safety cover.

26. The child care apparatus according to claim 18, wherein a fifth gap exists between a hole wall of the through hole and the lifting rod.

27. The child care apparatus according to claim 1, wherein the child care apparatus further comprises a mounting base, the mounting base comprises a bottom plate and supporting bases, and the supporting bases are disposed at two sides of the bottom plate; the horizontal reciprocating motion mechanism comprises at least two rails, and the at least two rails are respectively disposed between two of the supporting bases; a sixth gap exists between adjacent two of the at least two rails, the mounting cover is movably connected to the at least two rails, and a seventh gap exists between the mounting cover and the bottom plate.

28. The child care apparatus according to claim 27, wherein the mounting cover comprises at least two rolling assemblies, the at least two rolling assemblies are disposed at two sides of the mounting cover, and the mounting cover is movably connected to the at least two rails through the at least two rolling assemblies.

29. The child care apparatus according to claim 28, wherein four rolling assemblies are provided, first two of the four rolling assemblies are disposed at a first side of the mounting cover, and second two of the four rolling assemblies are disposed at a second side of the mounting cover.

30. The child care apparatus according to claim 28, wherein each of the at least two rolling assemblies comprises two rollers, the two rollers are oppositely disposed, each of the at least two rails is located between the two rollers and abuts against the two rollers.

31. The child care apparatus according to claim 30, wherein rail grooves are defined at two sides of each of the at least two rails, the rail grooves are disposed in a length direction of each of the at least two rails, and the two rollers are clamped in the rail grooves.

32. The child care apparatus according to claim 27, wherein the horizontal reciprocating motion mechanism further comprises a power mechanism, the power mechanism is connected to the mounting cover and the bottom plate, and the power mechanism is configured to drive the mounting cover to reciprocate back and forth in the length direction of each of the at least two rails.

33. The child care apparatus according to claim 32, wherein the power mechanism comprises a driving disc, a sliding block, a sliding groove, and a power source; the sliding block is eccentrically disposed on a disc surface of the driving disc, the sliding groove and the power source are disposed on the bottom plate, the power source is disposed in the mounting cover, the power source is connected to the driving disc, and the sliding block is movably clamped in the sliding groove.

34. The child care apparatus according to claim 33, wherein the sliding groove is strip-shaped, and the sliding groove is perpendicular to each of the at least two rails.

* * * * *